United States Patent [19]

Guthier

[11] Patent Number: 4,747,024

[45] Date of Patent: May 24, 1988

[54] ILLUMINATION DEVICE FOR SEWING MACHINES

[76] Inventor: Mary Guthier, 522 S. 9th St., Reading, Pa. 19602

[21] Appl. No.: 28,232

[22] Filed: Mar. 20, 1987

[51] Int. Cl.[4] ..... D05B 79/00

[52] U.S. Cl. ..... 362/90

[58] Field of Search ..... 108/23; 362/90, 97, 362/84

[56] References Cited

U.S. PATENT DOCUMENTS

| | | | |
|---|---|---|---|
| 3,862,409 | 1/1975 | Joella et al. | 362/90 |
| 3,867,624 | 2/1975 | Joella et al. | 362/90 |
| 4,138,620 | 2/1979 | Dickson | 362/84 |
| 4,559,582 | 12/1985 | Scardilli et al. | 362/84 |
| 4,622,623 | 11/1986 | Zei | 362/84 |

*Primary Examiner*—Charles J. Myhre
*Assistant Examiner*—David A. Okonsky
*Attorney, Agent, or Firm*—Leonard M. Quittner

[57] ABSTRACT

A planar electroluminescent light forms at least the upper surface of the throat or slide plate of a sewing machine to provide a light directed upwardly toward the area adjacent the foot and needle of the sewing machine.

6 Claims, 1 Drawing Sheet

FIG. 1
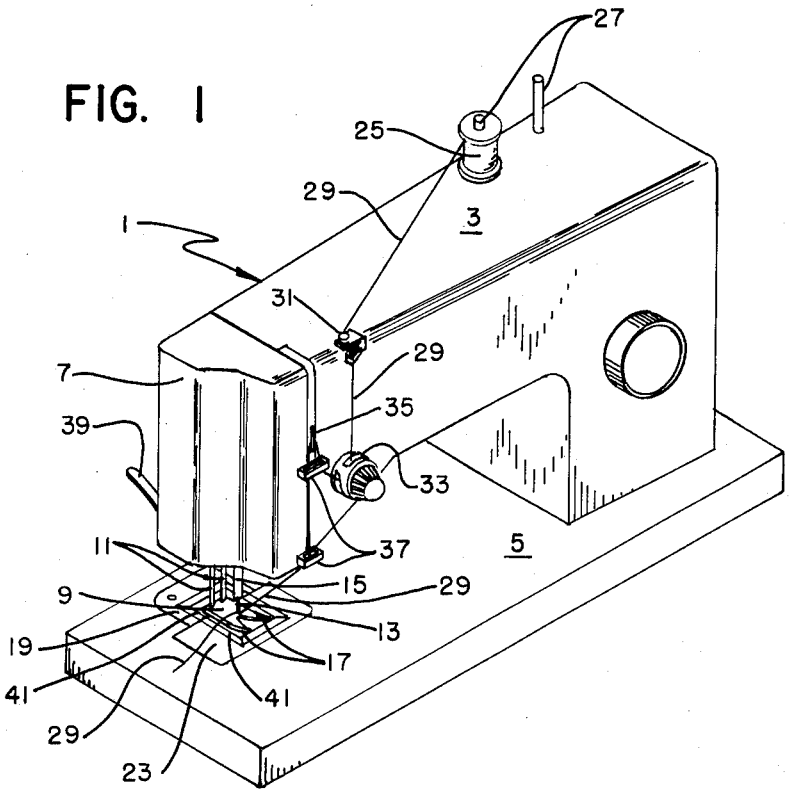
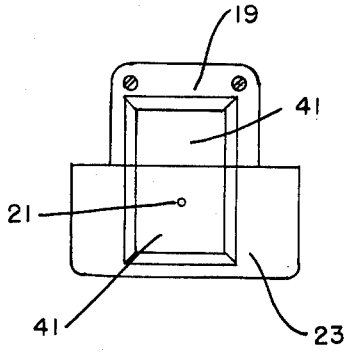
FIG. 3
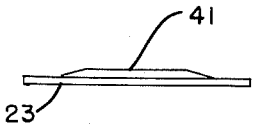
FIG. 2

ILLUMINATION DEVICE FOR SEWING MACHINES

CROSS-REFERENCE

There are no cross-references to, nor are there any related applications.

FEDERALLY SPONSORED RIGHTS The invention herein was made without any federal sponsorship or contribution.

BACKGROUND OF THE INVENTION

1. The Field of the Invention

The field of the invention relates to an improved sewing machine and more particularly to a novel device for illuminating work pieces from below to aid in properly aligning the work pieces as they are being fed to the power foot of a sewing machine.

2. Description of the Prior Art

When sewing work pieces together, it is necessary to prealign them so that they may be joined in a desired configuration. So too, a work piece may be prealigned over itself such as when making pleats or darts in a garment.

Several ways are known in the prior art to prelign work pieces. One of these uses holes cut in the work pieces to be sewn so that, when held to the light, the holes in the work pieces may be aligned in registry to each other and, while held in this position, laid onto the sewing table and fed to the power foot. Some misalignment may occur, however, when the work pieces are moved from a position in which they are held against the light down on to the sewing table. This method, and another by which the work pieces are marked with an ultra violet light indecia is discussed more fully in U.S. Pat. No. 3,862,409, the background teachings of which are incorporated herein by reference.

Referenced U.S. Pat. No. 3,862,409, discloses a light box (shadow box), mounted on a side area of a sewing table so as to minimize the required handling of the work piece in moving it under the power foot of the sewing machine after alignment. The concept of U.S. Pat. No. 3,862,409, is carried further in patent, U.S. Pat. No. 3,867,624, in which the light box is recessed into the sewing table at a location closer to the power foot. This makes it even easier to move the work piece from the surface of the light box after the components have been assembled without misaligning the several aligned parts. None the less, in the practice of either of these inventions, believed to disclose the closest prior art to the instant invention, some movement is required after the work pieces have been aligned to position them under the power foot of the sewing machine for sewing.

SUMMARY OF THE INVENTION

It is, accordingly, an object of this invention to provide an improved means for assembling and aligning work pieces in preparation to sewing them.

A further object of this invention is to provide an improved means to sew work pieces previously aligned while minimizing or eliminating the possibility of the work pieces moving out of misalignment as they are fed to the power foot of the sewing machine.

A further object of this invention is to provide a means whereby work pieces may be aligned and sewn as a continuous operation to insure, to the maximum extent, that a proper alignment will be maintained.

These and other objects of this invention are achieved by providing a source of light that shines upwardly immediately adjacent the area under the power foot and needle of a sewing machine. In a preferred practice of this invention, the upwardly directed light is a thin planar electroluminescent light that is mounted on or is an intrical part of either the throat plate or the slide plate of a sewing machine.

DESCRIPTION OF THE DRAWINGS

The present invention may be better understood by reference to FIG. 1 of the drawings which is a schematic perspective view of a portion of a sewing machine illustrating the apparatus of the instant invention. FIG. 2 is a side elevation and FIG. 3 is a plan view showing preferred embodiments of the device of this invention.

More specifically there is generally shown in the drawings a sewing machine (1) comprised of a cantilevered arm (3) which is supported on a sewing table (5). As illustrated in the drawing, the left portion of the sewing machine (1) includes a face plate (7) and, depending from the lower end of the arm (3), is a power foot (9) held by depending supports (11). A needle (13) is shown supported by a needle bar (15) which are adapted to reciprocate in an up and down motion between the toes (17) of the foot (9). Immediately under the foot (9) is a throat plate (19). The throat plate contains a small orifice (21) which is a hole through which the needle reciprocates through the plane of the table (5). A slide plate (23) abutts against the throat plate (19) to form a continuous planar surface upon which a work piece may be moved. The slide plate (23), when retracted literally away from the throat plate (19), provides access to a bobbin located under the throat plate (not shown). As shown in the drawing, a spool of thread (25) is mounted upon on an upstanding spindle (27). The thread (29) leaves the spool (25) passes through an upper thread guide (31), through tensioning discs (33), the upper take-up lever (35), the lower thread guide (37) and is threaded through the eye of the needle (13).

In the practice of this invention the upper surface of the throat plate (19) or slide plate (23), or both, are covered with a thin, flat, electroluminescent illuminating device or devices (41). The electroluminescent devices (41) may either be tiered to the top surfaces of either or both the throat plate (19) or slide plate (23) or may form an intrical part of these plates being held within a cut out portion of the plates (not shown). Electrical connections to provide power to the electroluminescent plate or plates may be made under the throat plate (19) and/or slide plate (23) by means (not shown) which are a simple matter of design well within the skill of the art.

By the above means, when a work piece is moved under the foot (9) of the sewing machine (1), illumination is provided by the electroluminescent plate or plates (41) immediately subadjacent the area where the work piece is moved by the power foot (9) to the needle (14) for sewing. Since the work pieces are aligned at the same time they are being positioned under the power foot (9), and sewn by the needle (13), there is no extraneous motion to enable the work pieces to move out of alignment because they are sewn together substantially at the same time that the alignment is accomplished.

Many modifications, variations and changes in detail may be made to the presently described embodiments and it is intended that all matter in the foregoing description and accompanying drawings be interpreted as illustrative and not by way of limitation.

What claimed is:

1. A sewing machine having a reciprocating needle, a power foot at least partially surrounding the needle, a throat plate located under the foot, a bobbin located under the throat plate, and a slide plate abutting the throat plate in planar sliding contact to provide access to the bobbin, the improvement comprising:

a planar electroluminescent light positioned directly beneath the foot whereby a work piece is illuminated from its underside as the work piece moves under the food and is being sewn by the needle.

2. A sewing machine according to claim 1 wherein the means for illumination is a planar electroluminescent light.

3. A sewing machine according to claim 1 wherein the planar electroluminescent light forms the upper surface of the throat plate.

4. A sewing machine according to claim 3 wherein the electroluminescent light forms the body portion of the throat plate.

5. A sewing machine according to claim 1 wherein the planar electroluminescent light forms the upper surface of the slide plate.

6. A sewing machine according to claim 5 wherein the electroluminescent light forms the body portion of the slide plate.

* * * * *